US007429331B2

(12) United States Patent
Lumsden et al.

(10) Patent No.: US 7,429,331 B2
(45) Date of Patent: Sep. 30, 2008

(54) APPARATUS AND PROCESS FOR INDUCING MAGNETISM

(75) Inventors: Barry Lumsden, Warrawee (AU); Robert Miner, deceased, late of Sydney (AU); by Maureen Helen Miner, legal representative, Sydney (AU)

(73) Assignee: Ausmetec Pty. Ltd., New South Wales (AU)

( * ) Notice: Subject to any disclaimer, the term of this patent is extended or adjusted under 35 U.S.C. 154(b) by 315 days.

(21) Appl. No.: 10/468,132

(22) PCT Filed: Feb. 15, 2002

(86) PCT No.: PCT/AU02/00201

§ 371 (c)(1),
(2), (4) Date: Mar. 22, 2004

(87) PCT Pub. No.: WO02/066166

PCT Pub. Date: Aug. 29, 2002

(65) Prior Publication Data

US 2004/0134849 A1 Jul. 15, 2004

(30) Foreign Application Priority Data

Feb. 16, 2001 (AU) ..... PR 3118
Feb. 16, 2001 (AU) ..... PR 3120

(51) Int. Cl.
*C02F 1/48* (2006.01)

(52) U.S. Cl. ..... 210/695; 210/222; 210/223; 210/391; 209/217; 209/232

(58) Field of Classification Search ..... 210/695, 210/791, 222, 223, 391, 411; 209/217, 223.2, 209/232.2, 232
See application file for complete search history.

(56) References Cited

U.S. PATENT DOCUMENTS 4,488,962 A 12/1984 Inoue (Continued)

FOREIGN PATENT DOCUMENTS

DE 154277 3/1982

(Continued)

OTHER PUBLICATIONS

Lane, John et al., "Condenser Water Treatment Using Pulsed Power," 2003 Cooling Technology Institute Annual Conference, San Antonio, TX.*

(Continued)

*Primary Examiner*—David A Reifsnyder
(74) *Attorney, Agent, or Firm*—Knobbe, Martens, Olson & Bear, LLP

(57) ABSTRACT

The present invention provides an apparatus for inducing magnetism in a flowstream of an at least partially magnetizable particulate feed material suspended in a liquid, the apparatus including: a treatment chamber having an inlet and an outlet through which the flowstream respectively enters and exits the chamber; and a magnetic source able to be selectively activated with respect to the treatment chamber, such that, when activated, the magnetic source induces magnetism in at least some of the particulate feed material located in the chamber. This allows the introduction of a high gradient magnetic field to effectively magnetize both the weakly and strongly magnetic particulates for subsequent removal by setting or other techniques. When the magnetic source is deactivated, the flow stream of feed material dissipates the deposits of magnetized material from around the source to reduce the possibility of any flow restrictions and maintain the effectiveness of magnets.

50 Claims, 1 Drawing Sheet

U.S. PATENT DOCUMENTS

| | | | | |
|---|---|---|---|---|
| 4,722,788 | A * | 2/1988 | Nakamura | 210/222 |
| 5,137,629 | A | 8/1992 | Dauchez | |
| 5,356,015 | A | 10/1994 | Notebaart et al. | |
| 7,217,368 | B2 * | 5/2007 | Lane | 210/222 |

FOREIGN PATENT DOCUMENTS

| | | |
|---|---|---|
| DE | 29723852 | 5/1999 |
| EP | 0022137 | 1/1981 |
| EP | 56717 | 7/1982 |
| EP | 434556 | 6/1991 |
| GB | 584392 | 1/1947 |
| SU | 526389 | 8/1976 |
| SU | 1005921 | 11/1981 |
| SU | 1278035 | 5/1985 |
| WO | WO99/32229 | 7/1999 |

OTHER PUBLICATIONS

A. Nafalski, S. Sobieraj and D. Kowalski, Magnetic Water Treatment-Attempts of Objective Explanation, *International Conference ELMECO '94,* pp. 161-165.

V. I. Klassen, Magnetic Treatment of Water in Mineral Processing, *XIII International Mineral Processing Congress,* Warsaw 1979, Ed. J. Laskowski. pp. 1077-1097.

C. Popescu, E. Andronescu and M. Tibu, "Effect of Magnetic Field on Certain Varieties of Wheat", *Buletinul Institutului Politehnic din lasi,* 1967, 13(3-4), pp. 293-298. (abstract only).

N. A. Volkonskii, V. I. Chalenko, B.K. Neroznak and V. F. Anikushkin, "Effect on Plants of Soil Water following its Magnetic-Hydrodynamic Treatment", *Vestnik Sel'skokhozyaistvennoi Nauki* (Moscow), 1978 7:93-96 (abstract only).

P. Penchev, V. Khristov, I. Nikolov, L. Prangov, N. Asenova and A. Gesheva, "Effect of Magnetically Treated Water on the Yield of Hothouse Tomatoes and Cucumbers", *Gradinaska I Lozarska Nauka,* 1976 13(6):82-87 (abstract only).

S. I. Lebedev, P.I. Baranski, L. G. Litvenenko and L.T. Shiyan, "Physiological-Biochemical characteristics of Plants after Presowing Treatment with a Stationary Magnetic Field", *Fiziologiya Rastenii,* 1975 22(1):103-9 (abstract only).

T. Kudrev, N. Manolova and P. Buchvarov, "Influence of Magnet-Treated Nutrient Solution on the Growth of Young Corn Plants", *Doklady Bolgarskoi Akademii Nauk,* 1977, 30(11):1617-20 (abstract only).

M. Markov, "Change in the Structure of Water and its Biological Activity Under the Effect of Constant Magnetic Fields", *Vzaimodeistvie Vodoi Zhivym Veshchestvom, Tr. Mezhdunar Simp.,* 1979, 2:9-12 (abstract only).

Y. Zhu, S. Cheng, Q. Lu and T. Jiang, "Testing and Evaluation of Magnetised Water", *Lihua Jianyan, huaxue Fence,* 2001, 37(6):279 (abstract only).

I. U. Merkulova and M. L. Mikhel'son, The Therapeutic Action of Magnetised Water on the Quality of Health at a Sanitorium, *Voprosy kurotologii, fizioterapii, I lechebnoi fizicheskoi kultury,* 1994 Mar.-Apr.(2):37-9 (abstract only).

G. V. Tyurev, N. A. Seliverstov and A. V. Shishkov, "Properties of Magnetised Water and its Effects on Lambs", *Vopr. Ispol'z. Ferromagnit. Zhidkosti v. S-kh Tekhn., L,* 1983, pp. 49-53 (abstract only).

J. Chowdhury and F. Tanzosh, "Magnetic Units: Views are still Poles Apart", *Chemical Engineering,* Jan. 23, 1984, pp. 22-25.

K. W. Busch and M. A. Busch, "Laboratory Studies on Magnetic Water Treatment and Their Relationship to a Possible Mechanism for Scale Reduction", *Desalination,* 109, 1977, pp. 131-148.

L. Garlaschelli, "Water and Magnets", *Chimica e l'Industria,* 1999, 81:4;, p. 474.

V. I. Klassen, "influence of magnetic field on the wettability of solids by water" *Doklady Akad Naik S.S.S.R.,* 166(6), 1966, p. 1383.

K. Kovatchev and G. Klisuranov, "Improvement of the Flotation of Copper Molybdenite Ores by Magnetic Treatment of Water Systems" *Rudodiv Metallurgiya,* (1969) No. 4, pp. 16-19.

K. Kovachev and G. Klisuranov, "Effect of Magnetic Field on Water and Aqueous System during Flotation of Copper Containing Ores", *Rudodiv Metallurgiya,* 1970, 25(2), pp. 12-15.

P. Illie, J. Pop and D. Szollosy, "Influence of magnetic field on Dressing Nonferrous Ores", *Revista Minelor,* 1969, 20(8), pp. 336-340.

O. B. Bruk, V. I. Klassen and O.T. Krylov, "On Mechanisms of Magnetic Treatment of Disperse Systems", *Electronnanya Obrabotka Materialov,* 1987 (6) pp. 32-36.

M. I. Chepelev, "Improvement in the Flotation of Finely Dispersed Pyrrhotite by Selective Flocculation", *Obogasch. Rud,* 1979, 24(2), pp. 27-29.

G. W. Heys and W. J. Bruckard, "Increasing the Recovery of Fine Particles by Flotation—Will Flocculating Particles Help?", *Proceedings of the 2002 Minerals Engineering Conference.*

F. N. Belash and O. V. Pngina, "Flotation of Iron and Manganese minerals with Treatment of the Pulp in a Magnetic Field", *Novye. Napravleniya Obogasshch USSR,* 1965, pp. 192-203.

A. A., Yousef, T. R. Boulos and M. A. Arafa, "Magnetic Beneficiation of Chromite ore", *Canadian Metallurgical Quarterly,* vol. 10(4), 1971, pp. 323-326.

R. I. Berdichevsky and V. V. Karmazin, "Flocculation of Magnetite Concentrates During Flotation in the Magnetic Field", *Obogaschsh Rud,* 1968, 13(1), pp. 41-43.

R. Singh, S. S. Rao, S. C. Maulik and N. Chakravorty, "Fine Particle Flotation—Recent Trends"< *Trans. Indian Inst. Met.,,* vol. 50, No. 5, Oct. 1997, pp. 407-419.

J. Svoboda, "Magnetic Methods for the Treatment of Minerals, Developments in Mineral Processing" *Elsevier,* vol. 8, 1987, pp. 19 & 32.

Newmont Golden Grove Operations Pty Ltd. "ProFlote Metallurgical Report", Mar. 2004.

Van Kleef et al. "Application of Magnetic Flocculation in a Continuous Flow Magnetic Separator", *IEEE Transactions on Magnetics,* vol. 20, Issue 5, Sep. 2984, pp. 1168-1170.

* cited by examiner

APPARATUS AND PROCESS FOR INDUCING MAGNETISM

RELATED APPLICATIONS

This application is the U.S. National Phase of PCT/AU02/00201 filed Feb. 15, 2002 and claims priority to Australian Provisional Patent Application No. PR3118 filed Feb. 16, 2001, and to Australian Provisional Patent Application No. PR3120 filed Feb. 16, 2001, which are hereby incorporated by reference herein.

BACKGROUND OF THE INVENTION

1. Field of the Invention

The present invention relates to an apparatus and process for magnetising a magnetisable material. In one form the invention relates to a process for inducing magnetism into a flow stream of particulate material to facilitate subsequent separation of some of the magnetised material and will primarily be described with reference to this context. It should be remembered, however, that the process of the invention may have broader use in systems not involving the subsequent separation of any of the magnetised material, such a general particulate settling and water clarification process.

2. Description of the Related Art

Devices for inducing a magnetic field into a magnetisable particulate suspension are known in the art and have been applied to coagulate fine particles. Prior to entering a settling tank for separation, such a particulate suspension can be passed through a vessel in which a magnetic field is applied. The magnetisable particles become magnetised and subsequently self-attracted. These self-attracted particles may then settle under the influence of gravity to the bottom region of the tank faster than they would have done as individual particles, without any need to use chemical coagulant or flocculation reagents. Such a process is useful for removing very fine particulates which generally do not separate quickly or easily under the influence of gravity.

The apparatus for such a process commonly makes use of a low gradient magnetic field having a small rate of change of magnetic strength. This type of magnetic field reduces the tendency of the magnetised particles to move toward the poles of the magnet/s that are used to create the magnetic field.

SUMMARY OF THE INVENTION

In a first aspect the present invention provides an apparatus for inducing magnetism in a flowstream of an at least partially magnetisable particulate feed material suspended in a liquid, in use to precondition the flowstream for a subsequent separation process in a separate stage, the apparatus including:

- a treatment chamber having an inlet and an outlet through which the flowstream respectively enters and exits the chamber; and
- a magnetic source able to be selectively activated with respect to the treatment chamber,
- such that, when activated, the magnetic source induces magnetism in at least some of the particulate feed material in the chamber.

Such an apparatus allows the introduction of a high gradient magnetic field to effectively magnetise the both weakly and strongly magnetic particulates for subsequent removal by settling or other techniques. When the magnetic source is activated both the weakly and strongly magnetic particulates are attracted toward that magnetic source and become, at least in part, magnetised. When the magnetic source is deactivated, the flow stream of feed material dissipates the deposits of magnetised material from around the source to reduce the possibility of any flow restrictions.

In the known apparatus if a high gradient magnetic field was used, the magnetic particles would be strongly attracted to the magnetic poles where they will collect and thus reduce the effectiveness (ie. the magnetic induction properties) of the magnets, as well as possibly restricting the flow of suspended particulate material in or through the vessel.

Additionally a low gradient magnetic field has a reduced ability to magnetise weakly magnetic particulates such as paramagnetic particulates. In a mixture of strongly magnetic particulates (such as ferromagnetic particles) and paramagnetic particulates, a low gradient magnetic field will be likely to only effectively magnetise the strongly magnetic particulates for subsequent removal by settling. Whilst a high gradient magnetic field may be preferable in order to magnetise both weakly and strongly magnetic particulates, the aforementioned problems of a reduction in the effectiveness of the magnets, as well as vessel flow restriction or blockage are likely to arise in the known apparatus and thus limit the use of such a magnetic field for such a purpose.

Preferably activation of the magnetic source involves moving that source into and out of proximity with the chamber.

Preferably the magnetic source is mounted on a motive means which causes the magnetic source to reciprocatingly move into and out of proximity with the treatment chamber. Most preferably the motive means is a piston.

Preferably the treatment chamber is annularly shaped, having an internal elongate recess into which the magnetic source is reciprocatingly receivable.

Preferably an interior face of the treatment chamber, which adjoins the internal elongate recess, has an expandable membrane positioned thereover, the expansion and contraction of which serves to dislodge particulate feed material which may adhere at the internal elongate recess.

Preferably the membrane is made of an elastomeric material which is expandable or contractable by the respective introduction into or removal of a fluid from the space between the membrane, and that part of the interior face of the treatment chamber which adjoins the internal elongate recess.

Preferably the treatment chamber has a fluid inlet through which a fluid is able to be introduced into the liquid to aid suspension of particulate feed material in that liquid.

Preferably the fluid inlet is joined to a flexible hose located internally of the treatment chamber the hose able to move flexibly within the chamber as fluid is passed therethrough to facilitate suspension of particulate feed material in the liquid.

Preferably the feed material includes paramagnetic and ferromagnetic particulates. The feed can also include diamagnetic or non-magnetic particulates (e.g. gangue minerals). Preferably the paramagnetic particulates include at least one sulfide mineral containing copper, zinc or another transition metal. Platinum and palladium metal is also paramagnetic and can be present in the feed material. Most preferably the paramagnetic particulates include at least one of the group including sphalerite contaminated with iron, arsenopyrite, cassiterite or chalcopyrite mineral.

In a second aspect the present invention provides an apparatus for magnetising a portion of a feed material, the portion including material fractions having a range of magnetic susceptibilities, the. apparatus including a treatment chamber and a magnetic source selectively activatable with respect to the treatment chamber to induce magnetism in the portion so as to facilitate the subsequent separation in a separate stage of a more weakly magnetic feed material fraction from a more strongly magnetic feed material fraction. The feed material may also include a diamagnetic or non-magnetic gangue component.

Preferably the more weakly magnetic feed material fraction includes mainly paramagnetic particulates and the more strongly magnetic feed material fraction includes mainly ferromagnetic particulates.

Preferably the apparatus of the second aspect is as defined in the first aspect.

Preferably the portion of the second aspect includes materials as defined in the first aspect.

In a third aspect the present invention provides an apparatus for inducing magnetism in a flowstream of an at least partially magnetisable particulate feed material suspended in a liquid, the apparatus including:

a treatment chamber having an inlet and an outlet through which the flowstream respectively enters and exits the chamber; and a magnetic source able to be selectively activated with respect to the treatment chamber, such that, when activated in use, the magnetic source induces magnetism in at least a portion of the particulate feed material in the chamber whilst maintaining that portion in the flowstream in the treatment chamber.

Preferably the apparatus of the third aspect is as defined in the first aspect.

Preferably the portion of the third aspect includes materials as defined in the first aspect.

In a fourth aspect the present invention provides an apparatus for inducing magnetism in an at least partially magnetisable particulate feed material suspended in a liquid, the apparatus including:

a treatment chamber for retaining the feed material; and a magnetic source able to be activated with respect to the treatment chamber, such that it induces magnetism in at least some of the particulate feed material located in the chamber, the treatment chamber having an interior face adjacent to which the magnetic source can be activated, with an expandable membrane positioned at least partly over that face, such that expansion and contraction of the membrane causes dislodgement of any particulate feed material which is adherent at the interior face as a result of the magnetic source. Such a membrane helps to dislodge or dissipate the deposits of magnetised material from around the source to reduce the possibility of any flow restrictions or blockage in the treatment chamber.

Preferably the magnetic source is selectively activatable with respect to the treatment chamber.

Preferably the membrane is made of an elastomeric material which is expandable or contractable by the respective introduction into or removal of a fluid from the space between the membrane and the interior face of the treatment chamber.

In a fifth aspect the present invention provides process for inducing magnetism in a flowstream of an at least partially magnetisable particulate feed material suspended in a liquid, in use to precondition the flowstream for a subsequent separation process in a separate stage, involving the steps of:

passing the flowstream through a treatment chamber; and selectively activating a magnetic source with respect to the treatment chamber, such that, when activated, the magnetic source induces magnetism in at least some of the particulate feed material located in the chamber.

Such a process allows the introduction of a high gradient magnetic field to effectively magnetise the both weakly and strongly magnetic particulates for subsequent removal by settling or other techniques. When the magnetic source is activated both the weakly and strongly magnetic particulates are attracted toward that magnetic source and become, at least in part, magnetised. When the magnetic source is deactivated, the flow stream of feed material dissipates the deposits of magnetised material from around the source to reduce the possibility of any flow restrictions.

Preferably the activation of the magnetic source involves moving that source into and out of proximity with the treatment chamber.

Preferably at least some of the magnetisable feed material is paramagnetic, the induced magnetism causing at least some of the magnetised paramagnetic particles to become aggregated in the liquid flowstream.

In a sixth aspect the present invention provides a process for magnetising a portion of a feed material, the portion including material fractions having a range of magnetic susceptibilities, the process including the steps of passing the feed through a treatment chamber and selectively activating a magnetic source with respect to the treatment chamber to induce magnetism in the portion so as to facilitate the subsequent separation in a separate stage of a more weakly magnetic feed material fraction from a more strongly magnetic feed material fraction.

Preferably the process also includes the step of subsequently separating the weakly magnetised feed material fraction from the more strongly magnetised feed material fraction by a flotation separation process. Most preferably the flotation separation process recovers the weakly magnetised feed material in a froth phase.

Preferably the more weakly magnetic feed material fraction includes mainly paramagnetic particulates and the more strongly magnetic feed material fraction includes mainly ferromagnetic particulates, as well as some diamagnetic or non-magnetic gangue particulates.

Preferably at least some of the magnetisable feed material is paramagnetic, the induced magnetism causing at least some of the magnetised paramagnetic particles to become aggregated in the liquid flowstream.

In a seventh aspect the present invention provides a process for inducing magnetism in a flowstream of an at least partially magnetisable particulate feed material suspended in a liquid involving the steps of:

passing the flowstream through a treatment chamber; and selectively activating a magnetic source with respect to the treatment chamber, such that, when activated in use, the magnetic source induces magnetism in at least a portion of the particulate feed material in the chamber whilst maintaining that portion in the flowstream in the treatment chamber.

Preferably the activation of the magnetic source involves moving that source into and out of proximity with the treatment chamber.

Preferably at least some of the magnetisable feed material is paramagnetic, the induced magnetism causing at least some of the magnetised paramagnetic particles to become aggregated in the liquid flowstream.

BRIEF DESCRIPTION OF THE DRAWINGS

Notwithstanding any other forms which may fall within the scope of the present invention, preferred forms of the invention will now be described, by way of example only, with reference to the accompanying drawings in which.

DETAILED DESCRIPTION OF THE PREFERRED EMBODIMENT

Figure 1:
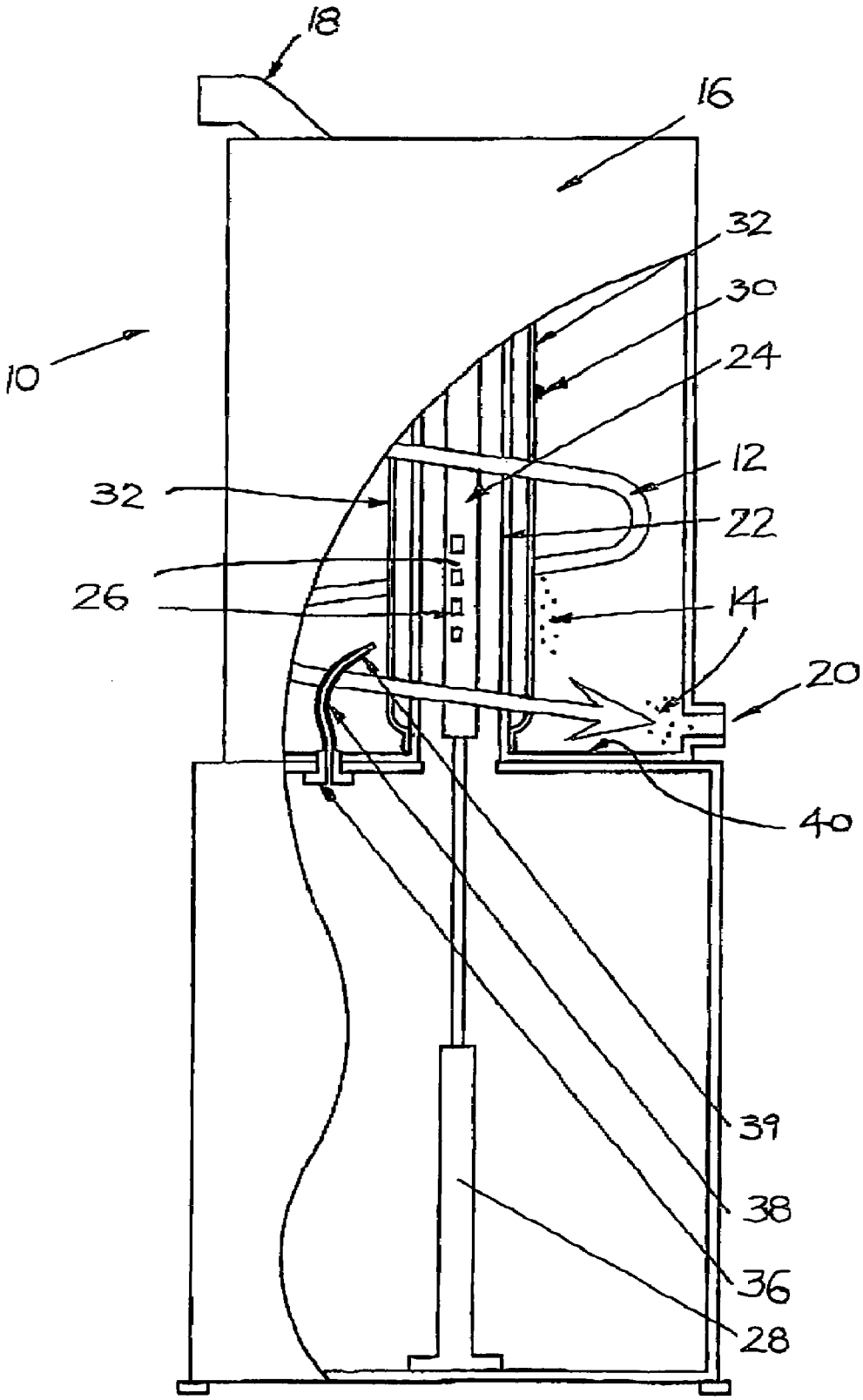
FIG. 1 shows a partially-sectioned side view of one embodiment of an apparatus for inducing magnetism in accordance with the invention.

In a preferred embodiment, the present invention provides an apparatus 10 for inducing magnetism in a flow stream 12 of an at least partially magnetisable particulate feed material 14 suspended in a liquid. The feed material typically includes a mixture of paramagnetic and ferromagnetic particulates present with other non-magnetic or diamagnetic gangue minerals in a water slurry. Paramagnetic particulates usually require a high gradient magnetic field in order to become magnetized. Some sulfide minerals containing copper (such as chalcopyrite), zinc (such as sphalerite contaminated with iron) or other transition metals are paramagnetic. Ferromagnetic particulates include iron oxide minerals (such as magnetite) and metallic iron particles (from worn grinding media, for example).

Referring to the drawing, the apparatus 10 includes a treatment chamber in the form of an annularly shaped vessel 16 with an uppermost inlet 18 and a lowermost outlet 20 through which a flow stream of the aforementioned mineral mixture can flow respectively into and out of the vessel 16 with some residence time therein. The apparatus can also be used in 'batch' mode, and does not require a continuous flow stream of the mineral slurry mixture.

The chamber vessel incorporates a central elongate recess 22. A magnetic source is able to be selectively activated to induces magnetism in at least some of the particulate feed material 14 located in the vessel 16 by movement of the magnetic source into and out of proximity with the vessel 16. In one preferred embodiment the magnetic source is at least one permanent magnet mounted on a motive means in the form of a piston which is connected to a drive so that the piston can be reciprocatingly moved into and out of the recess 22. In one preferred embodiment the piston 24 is cylindrically shaped, having a diameter of approximately 300 millimeters and is fitted with a number of inset permanent magnets 26 that are square in shape and have a side dimension of 50 millimeters, made of neodymium or other materials. The diameter of the recess 22 in the vessel 16 is 800 millimeters.

In further embodiments the permanent magnets can be of any shape, size or material and the piston need not be cylindrical, but can be square or triangular in crossection for example, and of any overall length. The means by which the piston is moved reciprocatingly with respect to the vessel can include any type of drive including a cam, a spring, an air cylinder (28, as illustrated) or an eccentrically rotatable shaft etc.

In still further embodiments the relative movement of the vessel and the magnetic source need not involve a piston being received into a recess in a vessel. The magnetic source need only be brought into proximity to the vessel, for example by being moved close to one side of a vessel so that a magnetic field can magnetise the particulate materials located in the vessel. In other embodiments the vessel itself may be able to be moved in relation to a stationary magnet. The vessel can be or any particular shape, size and orientation to facilitate the magnetic source coming into proximity to the vessel contents.

The apparatus 10 described allows the introduction of a high gradient magnetic field to effectively magnetize both the weakly and strongly magnetic particulates 14 for subsequent removal of all particulates by enhanced gravity settling or separation of the weakly magnetic particulates by techniques such as flotation. When the piston 24 carrying the magnets 26 is moved into the recess 22 of the vessel 16, both the weakly and strongly magnetic particulates 14 are attracted and migrate toward the portion of the interior face of the vessel 16 which adjoins the internal elongate recess 22. The particles then become, at least in part, magnetised. When the piston 24 carrying the magnets 26 is moved out of the recess 22, deposits of magnetised particulate material 14 are no longer held to the interior face by magnetic attraction and are mostly dissipated by the flow stream 12 of feed material in the vessel 16. Depending on the location and orientation of the inlet and outlet ports, the vessel contents can develop a swirling fluid motion (illustrated in the drawing by an arrow in the vessel 16). The dissipation of solids can reduce the possibility of any flow restrictions developing in the vessel and improve the efficiency of the magnet/s.

In still further embodiments a magnetic source can be selectively activated to induces magnetism in at least some of the particulate feed material located in the vessel by use of electromagnet/s located proximal to the vessel. The supply current fed to the electromagnet/s can be switched on and off repeatedly to provide the same effect as if a permanent magnet was moved in and out of proximity with the vessel. In still further embodiments the field of a permanent magnet can be shunted or blocked by moving a magnetic field barrier in between the permanent magnet and the vessel containing the magnetisable particulates.

The cycle or frequency of movement of the magnetic source may be initiated by a timing device or by sensors that detect the mass of accumulated particles 30. The measurement of this mass may be made by determining the interference to the magnetic field or by measuring the resistance to flow of the particulate slurry as the mars of particles 30 increases.

In the preferred embodiment shown in the drawing, the interior face of the vessel 16 that adjoins the internal elongate recess 22 has a thin, expandable, rubber membrane 32 positioned thereover. This membrane 32 can be expanded and subsequently contracted by the respective introduction into or removal of a gas such as air from the space 34 between the membrane 32 and that part of the interior face of the vessel which adjoins the internal elongate recess 22. The movement of the exterior of the membrane 32 serves to assist in the dislodgement of particulate feed material 30 which may be adherent at the internal elongate recess 22 so that these particulates may be dissipated by the flow stream 12 of feed material in the vessel 16. In further embodiments, the membrane need not be positioned over all of the interior face of the treatment chamber that adjoins the internal elongate recess 22, and may only be partly covering that face. In still further embodiments of the invention where the vessel is of a different shape, the flexible membrane can be positioned at any other position on the interior face of the vessel so that it lies between the magnetic source and the contents of the vessel to be magnetised while still being able to be expanded and subsequently contracted by a gas flow into or out of the space between the membrane and the interior face of the vessel.

In still further embodiments the flexible membrane can be stretched or moved by other means such as an injection of a fluid other than a gas into the space between the membrane and the interior face of the vessel or a vibratory device, for example. The membrane need not be made of rubber, but can be of any elastomeric material, e.g. plastics, synthetics.

The vessel of the preferred or another embodiment can also be agitated by internal or external mechanical means to facilitate the dissipation of accumulated magnetised material 30. For example motorized mixer blades can be used to stir the contents of the vessel. In the preferred embodiment shown in the drawing, the treatment chamber has a fluid inlet in the form of jet orifice 36 through which a gas such as air or a liquid ouch as water is able to be introduced into the liquid in the vessel 16 to aid suspension of the particulate feed material 14 in that is liquid. An introduced gas can fluidise any settled particulate material. The jet orifice 36 is joined to a length of flexible hose 38 located internally of the vessel. The hose 38 is fitted with an end nozzle 39. The hose 38 is able to move flexibly within the vessel 16 as gas or liquid is passed through it to facilitate fluidisation and suspension of particulate feed material 14 in the liquid in the vessel 16, and functions like a random agitator moving about the internal base 40 of the vessel 16. Such agitation is important to prevent settling when a decrease in the flow velocity of the particulate slurry through the vessel is required in order to increase the exposure time of the slurry particulates 14 to the magnetic field.

The flexible hose 38 has several advantages over use of a fixed fluid inlet jet orifice alone. Fixed jet orifices are limited in their area of coverage of the vessel base 40 and if mechanically pivotable jet orifices are used, they usually incorporate bearings, seals and other wear components that have a limited life in a wet and abrasive environment. The flexible hose 38 in the preferred embodiment sweeps over a large area of the vessel base 40 and used less introduced gas or liquid than a multiplicity of fixed jets would. The flexible hose 38 provides for a large sweep area over the vessel base 40 using a device that requires no bearings or seals In use the apparatus 10 can be used to induce magnetism in a flow stream 12 of an at least partially magnetizable particulate feed material 14 suspended in a liquid. Once the flow stream 12 (which by definition can also include a repeated sequence of batch treatment steps involving filling, treating and emptying of the vessel) of a particulate slurry is passing through the vessel 16, the magnetic source (be it an electromagnet or a mechanically actuated apparatus such as the preferred embodiment) can then be selectively activated to induce magnetism in at least some of the particulate feed material 14 located in the vessel 16. Such a process allows the introduction of a high gradient magnetic field to effectively magnetise the both weakly and strongly magnetic particulates for subsequent removal by settling, or separation by other techniques such as flotation. When the magnetic source is activated, both the weakly magnetic (e.g. paramagnetic) and strongly magnetic (e.g. ferromagnetic) particulates are attracted toward that magnetic source and become, at least in part, magnetised. When the magnetic source is deactivated, the flow stream 12 of feed material dissipates the majority of the deposits 30 of magnetised material to reduce the possibility or any flow restrictions in the vessel 16.

In the case of the paramagnetic feed material, the inventors have surprisingly discovered that the induced magnetism can cause at least some of the magnetized paramagnetic particles to become aggregated in the liquid flow stream. The inventors have observed that the aggregated paramagnetic particles remain aggregated for at least several hours and that the aggregated particles can survive further treatment steps in a mineral separation process such as pumping and agitation. In a feed with particulate materials of a range of magnetic susceptibilities, the preferred apparatus is able to be operated in a manner to facilitate the subsequent separation of the magnetised paramagnetic feed material fraction from the magnetised ferromagnetic feed material fraction. The magnetised paramagnetic feed fraction is also separable from the non-magnetic or diamagnetic gangue minerals.

In the experimental work, a flotation separation process was used on several finely ground mineral ores (typically with 80% of the ore particles of a particle size less than 100 micrometers in diameter) in order to separate the magnetised paramagnetic feed material into a froth phase. The experimental results have demonstrated good increases in sulfide mineral recovery by flotation due to the use of the magnetization treatment step prior to the flotation step (see forthcoming Example 3 results). The inventors believe that the very fine (e.g. <10 micrometer diameter) paramagnetic particles, which ordinarily exhibit poor flotation rates and recoveries, once magnetised, can become aggregated to give an 'effective' (coagulated) particle diameter of greater than 10 micrometers. Such aggregates can exhibit good flotation rate and recovery characteristics due to hydrodynamic reasons such as better attachment to rising air bubbles in a flotation cell.

The use of sulfide mineral collector reagents such as xanthates or dithiophosphates can ensure that the surfaces of the paramagnetic mineral particles become hydrophobic and more readily attach to the surface of the rising air bubbles in the flotation cell. Typically the ferromagnetic particles in a particulate mixture of paramagnetic and ferromagnetic minerals are rejected in a flotation process (having no affinity for xanthate or dithiophosphate collectors) and report to gangue or tailings. In the experiments conducted, the sulfide mineral collector reagents used were present in the magnetisation treatment vessel 16 prior to any subsequent flotation step. In experiments where no magnetic treatment step was applied prior to the flotation step, the feed to flotation containing sulfide mineral collector was still passed through the vessel 16 prior to being passed to the subsequent flotation apparatus. The flotation apparatus used can comprise any standard type of agitated flotation cell, flotation column or flotation, circuit.

As an example of the improvements that this apparatus and process have provided over that known in the prior art, experimental results produced using conventional froth flotation with and without the pretreatment step of the invention are now presented.

The present apparatus can allow the introduction of a very high gradient magnetic field to effectively magnetise the both weakly and strongly magnetic particulates. When the magnetic source is activated both the weakly and strongly magnetic particulates are attracted toward that magnetic source and become, at least in part, magnetised. Previous apparatus and methods have not allowed the use of very high gradient magnetic fields because of the problem of deposition of magnetized feed material around the magnetic source and the low degree of magnetization of the weakly magnetic particulates. A cyclical activation of the magnetic field in a feed slurry flow stream as well as use of the flexible membrane go some way to removing the problem of such deposition.

In Example 1, the influence of changing the magnetic field gradient on flotation recovery (%) and grade (wt %) parameters is demonstrated.

EXAMPLE 1

The effect of changing magnetic field strength on subsequent flotation recovery data in comparison to no magnetic pre-treatment

| | 3000 Gauss | 4500 Gauss |
|---|---|---|
| Increase in copper flotation Recovery (%) relative to no Magnetic Treatment | 0.6% | 0.5% |
| Increase in copper flotation Grade relative to no magnetic treatment | 0.2% | 4.3% |

A measure of the improvement in the flotation separation process is measured by the increase in the recovery and the grade (the purity of the separated mineral concentrate). In the results, while the magnetic field strengths of 3000 Gauss and 4500 Gauss give an effectively identical improvement in the recovery, there is a very large improvement in the purity of the separated copper and clearly 4500 Gauss is better than 3000 Gauss in this regard.

EXAMPLE 2

Effect of residence time in the magnetic field on subsequent copper flotation recovery

| | Residence time of slurry in magnetic field (minutes) | | | |
|---|---|---|---|---|
| | 0 | 2 | 4 | 8 |
| % Copper recovery to flotation concentrate | 88.6 | 90.8 | 92.3 | 95.1 |

From the results it appears that longer exposure times of paramagnetic particles to a magnetic field can yield improved mineral flotation recoveries, possibly because of the achievement of a greater degree of magnetisation of the paramagnetic value minerals, and an enhanced ability to self-attract.

EXAMPLE 3

Improvement achieved with magnetic treatment prior to flotation

| | |
|---|---|
| % Zinc flotation recovery - after magnetic treatment | 84.6 |
| % Zinc flotation recovery - before magnetic treatment | 82.6 |

These experimental results demonstrate the effect of a magnetisation treatment step yielding a beneficial increase in subsequent sulfide mineral flotation recovery.

The vessel and piston can be made of any suitable materials of construction which wear appropriately and that can be shaped, formed and fitted in the manners so described, such as a metal, metal alloy, hard plastics or ceramic. The expandable membrane and hose can be made of any suitable flexible materials that can be used in the manner so described.

It is to be understood that, if any prior art information is referred to herein, such reference does not constitute an admission that the information forms a part of the common general knowledge in the art, in Australia or any other country.

Whilst the invention has been described with reference to preferred embodiments it should be appreciated that the invention can be embodied in many other forms.

What is claimed is:

1. A separate preseparation conditioning apparatus for inducing magnetism in a flowstream of an at least partially magnetizable particulate feed material suspended in a liquid, in use to precondition the flowstream for a subsequent separation process in a separate stage; said at least partially magnetizable particulate feed material including a non-magnetizable particulate feed material and a magnetizable particulate feed material; said magnetizable particulate feed material including a relative strongly magnetizable portion and a relatively weakly magnetizable portion; the apparatus including:

a treatment chamber having an inlet and an outlet through which the flowstream respectively enters and exits the chamber and wherein the flow stream is delivered to the subsequent separate separation process upon exiting the treatment chamber; and a magnetic source able to be selectively activated with respect to the treatment chamber, such that, when activated, the magnetic source magnetizes said strongly magnetizable portion and said relatively weakly magnetizable portion in at least some of the particulate feed material in the chamber thereby to increase selectivity of separation in said subsequent separate separation process of said more weakly magnetizable portion of said at least partially magnetizable particulate feed material, said magnetic source, when deactivated returns substantially all of the magnetized particulate feed material to said flow stream for treatment in said subsequent separate separation stage.

2. The apparatus of claim 1, wherein said magnetic source induces a high strength or high gradient magnetic field in said flow stream.

3. The apparatus of claim 2, wherein said chamber is sized with reference to said flowstream so as to cause said at least partially magnetizable particulate feed material to be exposed to said high strength magnetic field for a predetermined period of time while passing through said treatment chamber.

4. The apparatus of claim 3, wherein said particulate feed material remains in said flowstream as a continuous flow of material from said treatment chamber to said separate stage wherein said subsequent separation process occurs.

5. An apparatus as claimed in claim 1, wherein activation of the magnetic source involves moving that source into and out of proximity with the chamber.

6. An apparatus as claimed in claim 5, wherein the magnetic source is mounted on a motive means which causes the magnetic source to reciprocatingly move into and out of proximity with the treatment chamber.

7. An apparatus as claimed in claim 6, wherein the motive means is a piston.

8. An apparatus as claimed in claim 1, wherein the treatment chamber is annularly shaped, having an internal elongate recess into which the magnetic source is reciprocatingly receivable.

9. An apparatus as claimed in claim 8, wherein an interior face of the treatment chamber, which adjoins the internal elongate recess, has an expandable membrane positioned thereover, the expansion and contraction of which serves to dislodge particulate feed material which may adhere at the internal elongate recess.

10. An apparatus as claimed in claim 9, wherein the membrane is made of an elastomeric material which is expandable or contractible by the respective introduction into or removal of a fluid from the space between the membrane, and that part of the interior face of the treatment chamber which adjoins the internal elongate recess.

11. An apparatus as claimed in claim 1, wherein the treatment chamber has a fluid inlet through which a fluid is able to be introduced into the liquid to aid suspension of particulate feed material in that liquid.

12. An apparatus as claimed in claim 11, wherein the fluid inlet is joined to a flexible hose located internally of the treatment chamber, and wherein the hose is able to move flexibly within the chamber as fluid is passed therethrough to facilitate suspension of particulate feed material in the liquid.

13. An apparatus as claimed in claim 1, wherein the feed material includes paramagnetic and ferromagnetic particulates.

14. An apparatus as claimed in claim 13, wherein the paramagnetic particulates include at least one sulfide mineral containing copper, zinc, or another transition metal.

15. An apparatus as claimed in claim 13, wherein the paramagnetic particulates are selected from the group consisting of sphalerite contaminated with iron, arsenopyrite, cassiterite, chalcopyrite, platinum metal, and palladium metal.

16. An apparatus for magnetizing a portion of a feed material, the portion including material fractions having a range of magnetic susceptibilities, the apparatus including a treatment chamber and a magnetic source selectively activatable with respect to the treatment chamber to induce differentially magnetized particles so as to facilitate the subsequent separation in a separate stage outside of the treatment chamber of a more weakly magnetized portion of the feed material fraction from a more strongly magnetic feed material fraction wherein the treatment chamber has an outlet wherein substantially all of the magnetized particles are outflowed following deactivation of the magnetic source for subsequent separation after magnetization.

17. The apparatus of claim 16, wherein said magnetic source induces a high strength or high gradient magnetic field in said flow stream.

18. The apparatus of claim 17, wherein said chamber is sized with reference to said flowstream so as to cause said at least partially magnetizable particulate feed material to be exposed to said high strength magnetic field for a predetermined period of time while passing through said treatment chamber.

19. The apparatus of claim 18, wherein said particulate feed material remains in said flowstream as a continuous flow of material from said treatment chamber to said separate stage wherein said subsequent separation process occurs.

20. An apparatus as claimed in claim 16, wherein the more weakly magnetic feed material fraction includes mainly paramagnetic particulates and the more strongly magnetic feed material fraction includes mainly ferromagnetic particulates.

21. An apparatus for inducing magnetism in a flowstream of an at least partially magnetizable particulate feed material suspended in a liquid, the apparatus including:

a treatment chamber having an inlet and an outlet though which the flowstream respectively enters and exits the chamber; and a magnetic source able to be selectively activated with respect to the treatment chamber, such that, when activated in use, the magnetic source induces magnetism in at least a portion of the particulate feed material in the chamber while maintaining that portion in the flowstream in the treatment chamber so that the substantially all of the magnetized portion exits the treatment chamber with the flowstream for subsequent separation after magnetization; and wherein the magnetizable particulate feed material is differentiated by the magnetic source into more strongly and a more weakly magnetized portions.

22. The apparatus of claim 21, wherein said magnetic source induces a high strength or high gradient magnetic field in said flow stream.

23. The apparatus of claim 22, wherein said chamber is sized with reference to said flowstream so as to cause said at least partially magnetizable particulate feed material to be exposed to said high strength magnetic field for a predetermined period of time while passing through said treatment chamber.

24. The apparatus of claim 23, wherein said particulate feed material remains in said flowstream as a continuous flow of material from said treatment chamber to said separate stage wherein said subsequent separation process occurs.

25. An apparatus for inducing magnetism in an at least partially magnetizable particulate feed material suspended in a liquid, the apparatus including:

a treatment chamber for retaining the feed material; and a magnetic source able to be activated with respect to the treatment chamber, such that it induces magnetism in at least some of the particulate feed material located in the chamber, wherein the treatment chamber has an interior face adjacent to which the magnetic source can be activated, with an expandable membrane positioned at least partly over that face, such that expansion and contraction of the membrane causes dislodgment of any particulate feed material which is adherent at the interior face as a result of the magnetic source.

26. The apparatus of claim 25, wherein said magnetic source induces a high strength or high gradient magnetic field in said flow stream.

27. The apparatus of claim 26, wherein said chamber is sized with reference to said flowstream so as to cause said at least partially magnetizable particulate feed material to be exposed to said high strength magnetic field for a predetermined period of time while passing through said treatment chamber.

28. The apparatus of claim 27, wherein said particulate feed material remains in said flowstream as a continuous flow of material from said treatment chamber to said separate stage wherein said subsequent separation process occurs.

29. An apparatus as claimed in claim 28, wherein the magnetic source is selectively activatable with respect to the treatment chamber.

30. An apparatus as claimed in claim 28, wherein the membrane is made of an elastomeric material which is expandable or contractible by the respective introduction into or removal of a fluid from the space between the membrane and the interior face of the treatment chamber.

31. A process for inducing magnetism in a flowstream of an at least partially magnetizable particulate feed material suspended in a liquid, in use to precondition the flowstream for a subsequent separation process in a separate stage, involving the steps of:

passing the flowstream through a treatment chamber before delivering the flowstream to the subsequent separate separation process; and selectively activating a magnetic source with respect to the treatment chamber, such that, when activated, the magnetic source induces magnetism in at least some of the particulate feed material in the chamber wherein said magnetic source, when deactivated, returns substantially all the magnetized particulate feed material to the flowstream for treatment in said subsequent separate separation stage; the magnetized particulate feed material returned to the flowstream has a more strongly magnetized portion and a more weakly magnetized portion.

32. The process of claim 31, wherein said magnetic source induces a high strength or high gradient magnetic field in said flow stream.

33. The process of claim 32, wherein said chamber is sized with reference to said flowstream so as to cause said at least partially magnetizable particulate feed material to be exposed to said high strength magnetic field for a predetermined period of time while passing through said treatment chamber.

34. The process of claim 33, wherein said particulate feed material remains in said flowstream as a continuous flow of material from said treatment chamber to said separate stage wherein said subsequent separation process occurs.

35. A process as claimed in claim 31, wherein activation of the magnetic source involves moving that source into and out of proximity with the treatment chamber.

36. A process as claimed in claim 31, wherein at least some of the magnetizable feed material is paramagnetic, the induced magnetism causing at least some of the magnetized paramagnetic particles to become aggregated in the liquid flowstream.

37. A process for magnetizing a portion of a feed material, the portion including material fractions having a range of magnetic susceptibilities, the process including the steps of passing the feed through a treatment chamber and selectively activating a magnetic source with respect to the treatment chamber to induce magnetism in the portion so as to facilitate the subsequent separation in a separate stage of a more weakly magnetic feed material fraction from a more strongly magnetic feed material fraction wherein substantially all the magnetized portion is outflowed following deactivation of the magnetic source of the treatment chamber following magnetization for subsequent separation.

38. The process of claim 37, wherein said magnetic source induces a high strength or high gradient magnetic field in said flow stream.

39. The process of claim 38, wherein said chamber is sized with reference to said flowstream so as to cause said at least partially magnetizable particulate feed material to be exposed to said high strength magnetic field for a predetermined period of time while passing through said treatment chamber.

40. The process of claim 39, wherein said particulate feed material remains in said flowstream as a continuous flow of material from said treatment chamber to said separate stage wherein said subsequent separation process occurs.

41. A process as defined in claim 37, also including the step of subsequently separating the weakly magnetized feed material fraction from the more strongly magnetized feed material fraction by a flotation separation process.

42. A process as defined in claim 41, wherein the flotation separation process recovers the weakly magnetized feed material in a froth phase.

43. A process as claimed in claim 37, wherein the more weakly magnetic feed material fraction includes mainly paramagnetic particulates and the more strongly magnetic feed material fraction includes mainly ferromagnetic particulates.

44. A process as claimed in claim 37, wherein at least some of the magnetizable feed material is paramagnetic, the induced magnetism causing at least some of the magnetized paramagnetic particles to become aggregated in the liquid flowstream.

45. A process for inducing magnetism in a flowstream of an at least partially magnetizable particulate feed material suspended in a liquid involving the steps of:

passing the flowstream through a treatment chamber; and selectively activating a magnetic source with respect to the treatment chamber such that, when activated in use, the magnetic source induces magnetism in at least a portion of the particulate feed material in the chamber while maintaining that portion in the flowstream in the treatment chamber so that substantially all of the magnetized portion exits the treatment chamber with the flowstream following deactivation of the magnetic source for subsequent separation of the magnetized portion in a separate separation process; the magnetized portion exiting the chamber comprised of a more strongly magnetized portion and a more weakly magnetized portion.

46. The process of claim 45, wherein said magnetic source induces a high strength or high gradient magnetic field in said flow stream.

47. The process of claim 46, wherein said chamber is sized with reference to said flowstream so as to cause said at least partially magnetizable particulate feed material to be exposed to said high strength magnetic field for a predetermined period of time while passing through said treatment chamber.

48. The process of claim 47, wherein said particulate feed material remains in said flowstream as a continuous flow or material from said treatment chamber to said separate stage wherein said subsequent separation process occurs.

49. A process as claimed in claim 45, wherein activation of the magnetic source involves moving that source into and out of proximity with the treatment chamber.

50. A process as claimed in claim 45, wherein at least some of the magnetizable feed material is paramagnetic, the induced magnetism causing at least some of the magnetized paramagnetic particles to become aggregated in the liquid flowstream.

* * * * *